United States Patent [19]

Huson

[11] Patent Number: 4,466,535

[45] Date of Patent: Aug. 21, 1984

[54] SLIP SEAL JOINT FOR STRAP

[75] Inventor: Gale W. Huson, Glenview, Ill.

[73] Assignee: Signode Corporation, Glenview, Ill.

[21] Appl. No.: 454,257

[22] Filed: Dec. 29, 1982

[51] Int. Cl.[3] ..... B65D 71/00

[52] U.S. Cl. ..... 206/83.5; 24/23 W; 428/57

[58] Field of Search ..... 428/57; 24/23 W, 23 B, 24/22; 206/83.5

[56] References Cited

U.S. PATENT DOCUMENTS 3,921,799 8/1979 Beach et al. .

4,253,227 3/1981 Bullington ..... 24/23 W X

OTHER PUBLICATIONS

Pages 1, 7, 10 & 11 and cover sheet of Catalog-26 entitled, "Signode Systems" ©1974 Signode Corporation, 2600 N. Western Ave., Chicago, Illinois 60647.

Title page and pp. 52 and 53 of Circular 736, U.S. Department of Agriculture entitled, "The Packaging of American Cotton and Methods for Improvement", 1945.

Operation and Safety Manual entitled, "Signode, Model M361, Power Strapping Machine", Signode Corporation, 3600 West Lake Avenue, Glenview, Ill. 60025.

*Primary Examiner*—Alexander Thomas

*Attorney, Agent, or Firm*—Dressler, Goldsmith, Shore Sutker & Milnamow, Ltd.

[57] ABSTRACT

A strap seal joint and method for applying a seal to the overlapping ends of a strap about a bale of resilient material are disclosed. The bale is preferably initially restrained against expansion in a press. The strap is provided with two oppositely facing major side surfaces having predetermined frictional characteristics. The strap is looped around the bale with a predetermined length of an inner end portion of the strap adjacent the bale extending at least partially around a corner of the bale and being overlapped by an outer end portion of the strap. The seal is applied to the overlapping end portions of the strap and deformed to crimp the seal against the outer end portion sufficiently to prevent withdrawal of the strap outer end portion from the closed seal. The seal is also crimped against the strap inner end portion with a predetermined degree of frictional force engagement which, in combination with the frictional forces between the bale and the strap as well as between the overlapping strap portions resulting from subsequent bale expansion, is sufficiently great to initially restrain the strap inner end portion relative to the seal at least until the press is opened but which is sufficiently low to permit relative movement between the overlapping strap end portions when the tension force on the strap exceeds a predetermined tension force.

2 Claims, 6 Drawing Figures

SLIP SEAL JOINT FOR STRAP

CROSS REFERENCE TO RELATED APPLICATION

A method for strapping a bale of resilient material with a strap and a partially notched seal connection of the overlapping end portions of the strap which permits some slippage under certain circumstances are disclosed in the concurrently filed and commonly assigned patent application of Clement A. Urban and Gale W. Huson entitled, "SLIP SEAL JOINT FOR STRAP", Ser. No. 454,256.

TECHNICAL FIELD

This invention relates to a connection or joint in a strap around resilient material and to a method for forming such a connection.

BACKGROUND OF THE INVENTION

The present invention is directed to retaining natural and synthetic fibers and other resilient material in bales, and it is intended to be especially useful in the cotton industry for maintaining cotton in bales of a desired shape and size, such as, for example, the widely used "Universal Density" bales.

Typically, a plurality of metal straps (called "bale ties") are looped around a bale of cotton at spaced-apart locations and the overlapping strap ends are secured to retain the bale at the desired density and shape. It is desirable that the bale ties, and the means for securing the overlapping ends of the bale ties, be able to accommodate efficient and safe application to the cotton bale and be capable of maintaining their integrity during the subsequent handling and transporation of the bale.

Proper design is especially important for bale ties used on higher density bales which necessarily have a higher degree of compression and therefore impose a greater amount of tension force in the bale ties. Also, the means for connecting the overlapping ends of each such high density bale tie must be able to withstand the tension forces imposed by the bale.

One conventional means for securing the overlapping ends of a bale tie employs a metal seal that is deformed about the overlapping ends of the metal strap comprising the bale tie. Examples of some types of metal seals used for cotton bale ties are disclosed in the U.S. Pat. No. 3,921,799 which is assigned to the assignee of the present invention.

One widely used type of metal seal has a generally C-shaped cross section. The seal has a crown portion and a pair of opposed side flanges or legs. The legs are adapted to be deformed about the overlapping end portions of the strap so as to cause the overlapping strap end portions to be held in surface-to-surface engagement between the seal crown and the seal legs.

Such a seal is applied to the overlapping end portions of the strap to prevent relative movement between the two overlapping strap end portions. The seal necessarily also prevents relative movement between the seal per se and both of the overlapping strap end portions. Such a seal must therefore be applied to the overlapping strap end portions in a manner that will effect sufficient engagement to withstand the tension forces imposed upon the strap by the outward pressure of the bale as well as to withstand the other forces that may be imposed upon the strap and/or seal as a result of handling, snagging, etc.

One conventional approach to applying such a seal includes notching or cutting into the seal as well as into the two overlapping strap end portions while displacing or offsetting portions of the strap relative to portions of the seal. This effects an engagement between the seal and the strap.

In an alternative approach, the seal is crimped but not notched or cut, whereby slipping or yielding can occur at the seal.

To ensure that the strap and seal on a bale do not break or become loose, the strap, the seal, and the engagement of the strap and seal must be designed to accommodate some selected maximum loading condition. It is difficult to select the maximum design strength of the assembled system of the strap and seal (in place on a bale) since the density to which the bale is compressed is not controlled by the designer of the strap and seal. Further, the designer of the strap and seal does not control the handling and storage of the strapped bale which may subject the bale to unexpectedly high impact or environmental loads.

As a result of these problems, the designer of a strap and seal system may attempt to "overdesign" the system to accommodate those very high continuous and/or transient loads which may affect only a relatively small percentage of the bales. Even with such overdesign, a bale in the field may be subjected to certain loading combinations which can cause failure of one or more of the straps and/or seals on the bale.

Accordingly, it would be desirable to provide a means for securing overlapping end portions of a bale tie or strap around a compressed bale so as to have the capability for accommodating overload conditions. Further, it would be desirable to provide an efficient and relatively simple method for so strapping a bale to accommodate such overload conditions.

It would also be advantageous to reduce, if not eliminate all together, the likelihood of catastrophic failure of the strap and/or seal. In some applications, it may also be beneficial to secure the seal to the strap without notching or cutting either the seal or the strap. This would avoid reduction of the cross section of the strap and of the seal and would eliminate sharp edges and corners which might otherwise snag or scratch adjacent surfaces during handling of the bale.

SUMMARY OF THE INVENTION

A seal joint for a loop of strap around a bale of compressed material and a method for applying the strap and seal in a combination around the bale are disclosed herein.

The material is initially compressed, as with a press, in a bale with side surfaces generally defining a prism. Preferably, the bale is initially restrained so that at least two oppositely facing side surfaces are compressed inwardly towards each other.

At least one strap is employed for tying the bale. The strap is disposed in a loop around the restrained bale to overlap a predetermined length of an inner end portion of the strap adjacent the bale with an outer end portion of the strap. The strap is arranged on the compressed and restrained bale so that the strap inner end portion is disposed around a bale corner defined by two of the bale side surfaces.

A seal is deformed about both of the overlapping strap end portions to close the seal. The step of deforming the seal includes the steps of (1) crimping one part of the seal against one strap end portion sufficiently to prevent withdrawal of the one strap end portion from the closed seal, and (2) crimping the other part of the seal against the other strap end portion with a predetermined degree of frictional force engagement.

The predetermined degree of frictional force engagement is, in combination with the frictional forces between the bale and strap as well as between the overlapping strap portions resulting from the subsequent bale expansion, sufficiently great to restrain the other strap end portion relative to the seal when the imposed tension force on the strap is equal to or less than a predetermined tension force. However, the predetermined degree of frictional force engagement is sufficiently low, to permit relative movement between the overlapping strap end portions when the tension force on the strap exceeds the predetermined tension force.

The seal joint permits relative movement of the overlapping strap ends when the strap is subjected to excessive forces so that the strap will be better able to accommodate the application of such excessive forces without breaking or causing failure of the seal. Thus, the likelihood of catastrophic failure of the strap and/or seal is reduced, if not eliminated all together.

Numerous other features of the disclosed strapping method and seal joint will be apparent from the following detailed description and accompanying drawings.

DESCRIPTION OF THE PREFERRED EMBODIMENT

The specification and accompanying drawings disclose one specific form as an example of the use of the invention. The invention is not intended to be limited to the embodiment illustrated, and the scope of the invention is pointed out in the appended claims.

Figure 1:
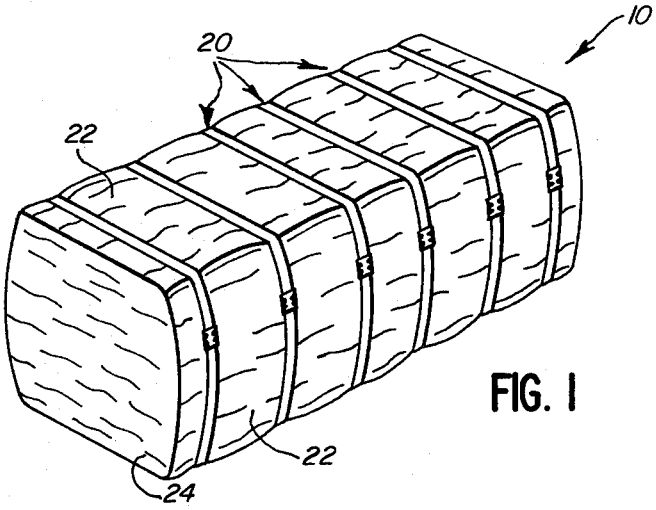
FIG. 1 is a perspective view of material retained in a bale by a plurality of straps secured with the seal joint disclosed herein.

A package or bale 10 of compressed material is illustrated in FIG. 1. The material, which may include any resilient material suitable for baling (such as cotton, hay, tobacco, and the like), is retained in the bale 10 by a plurality of bale ties or straps 20.

The bale 10 has sides generally defining a prism. Typically, the bale will have a prism or parallelpiped shape with four side surfaces 22 and two oppositely facing end surfaces 24. The exterior surfaces of the bale 10 need not be necessarily perfectly flat or planar. Some amount of curvature may exist on each surface and the corners may be somewhat rounded, especially underneath the straps 20.

Although the corners of the bale 10 may be somewhat rounded, the present invention contemplates that a sufficient corner configuration is defined by the bale 10 so as to permit each strap 20 to undergo a significant change in direction as it extends along one side surface at the corner, around the corner, and then along the other side surface at the corner. Further, the present invention contemplates that the material in the bale 10 is, or can be, sufficiently compressed so that the bale 10 tends to expand outwardly in at least one direction of expansion generally perpendicular to two oppositely facing side surfaces of the bale.

The material of the bale 10 may have been initially compressed into a relatively large, low density bale (not illustrated) and then bound by suitable straps, including straps such as straps 20. Such a large, low density bale is then further compressed to the smaller, higher density configuration illustrated so that the first set of straps can be removed and so that the material can be retained as the bale 10 with the illustrated set of straps 20.

Figure 2:
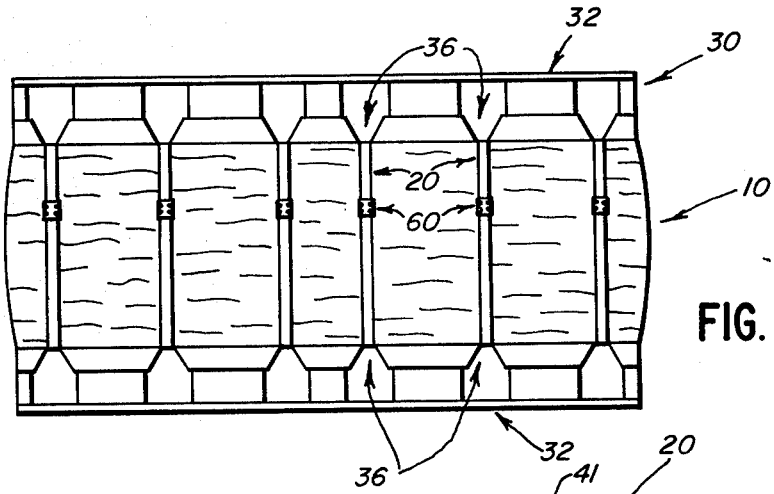
FIG. 2 is a simplified, side view of the strapped bale of FIG. 1 shown just prior to being removed from a closed press (the conventional press structure, other than the illustrated follower block weldments, being omitted)

FIG. 2 illustrates the bale 10 being formed in a suitable baling press 30. The press 30 in FIG. 2 may be used to initially form the bale 10 from unbaled material or may be used to form the bale 10 from a larger, low density bale. In any case, the press 30 includes conventional mechanisms known to those skilled in the art and which are not illustrated or described here except for the follower block weldments 32.

The weldments 32 are pressed into engagement with oppositely facing side surfaces of the bale 10 by suitable conventional mechanisms. The weldments 32 define generally V-shaped access regions, channels, or chutes 36 through which the straps 20 are passed as the straps 20 are positioned around the bale 10. The straps 20 may be disposed about the bale 10 somewhat loosely by hand or snugly with suitable conventional automatic apparatus known to those skilled in that art. The straps 20 may be nonuniformly spaced along the bale as illustrated in accordance with conventional practice to accommodate the bale expansion forces and retain the bale in the desired shape.

The bale 10 is initially compressed and restrained in the press 30 against expansion at a first nominal density as illustrated in FIG. 2 to permit the application of the straps 20 to the bale. When the press 30 is opened, the bale 10 expands somewhat—depending on how snugly the straps 20 were applied—to a second nominal density which necessarily is somewhat less than the first nominal density.

If the straps 20 had been initially applied to the bale 10 relatively snugly, then the actual expansion of the bale 10 may be minimal. However, the bale 10 will, of course, exert expansion forces on the straps 20 in either case. As explained in detail hereinafter, the straps 20 are secured by means to retain the bale at the desired shape and size in a way that will also accommodate excessive transient loads.

Figure 6:
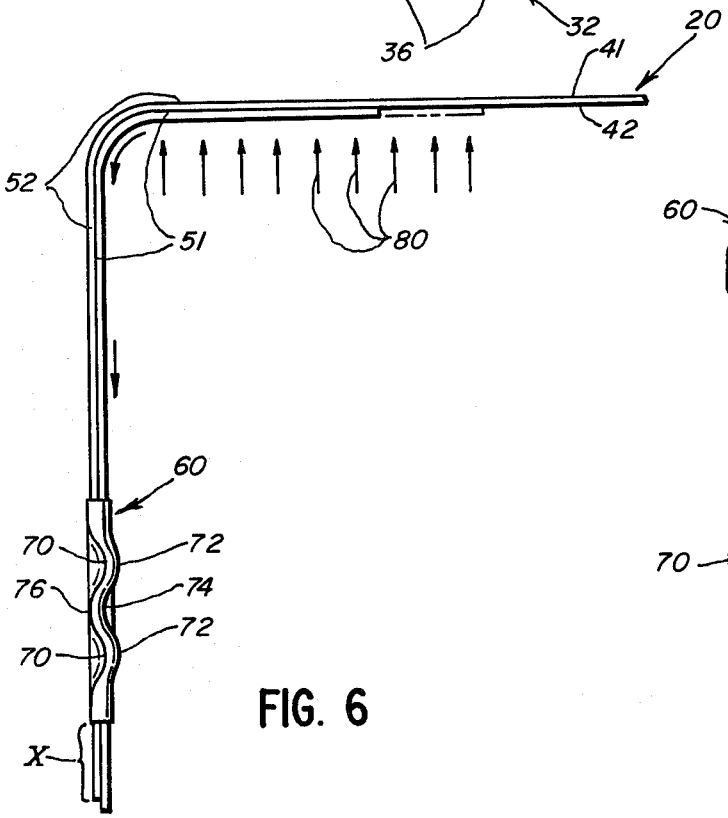
FIG. 6 is an enlarged, side view of the strap and seal disposed adjacent one corner of the bale with the bale material being omitted for purposes of clarity to illustrate relative movement between the overlapping strap ends.

Each strap 20, as best illustrated in FIG. 6, has two oppositely facing major side surfaces 41 and 42. The side surfaces 41 and 42 have known or predetermined frictional characteristics. The strap 20 is disposed in a loop around the bale 10 so as to overlap a predetermined length of an inner end portion 51 of the strap adjacent the bale 10 with an outer end portion 52 of the strap. As best illustrated in FIG. 6, the strap 20 is disposed around the restrained bale 10 so that the strap inner end portion 51 extends along and against one side surface of the bale, around the corner of the bale at the bale corner, and then along and against the other side surface of the bale at that corner. The confronting strap surfaces of the overlapping end portions 51 and 52 will thus tend to lie in surface contact, or will at least be generally aligned so that they can be ultimately forced together in surface contact, so as to effect a frictional engagement.

An open seal 60 is provided for being applied to the overlapping end portions 51 and 52 of the strap 20. The seal 60 has a crown 62 adapted to be disposed adjacent one of the overlapping strap portions (e.g., the strap outer end portion 52 as illustrated in FIG. 4) and has a pair of flanges or legs 64 adapted to be disposed adjacent the other of the strap end portions (e.g., the strap inner end portion 51 as illustrated in FIG. 4).

Figure 4:
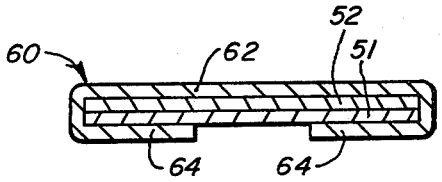
FIG. 4 is a greatly enlarged, cross-sectional view taken generally along the plane 4—4 in FIG. 3.

The seal 60 is initially provided in an "open" orientation (not illustrated) wherein the legs 64 are not bent inwardly as illustrated in FIG. 4 but instead project outwardly from, and at an angle to, the crown 62 by an amount sufficient to permit the seal 60 to be initially disposed against the overlapping strap portions. Subsequently, the seal legs 64 are closed about the overlapping strap portions as will be described hereinafter in detail.

It is not necessary that the seal 60 have the precise structure described above with reference to FIG. 4. It is sufficient that the seal 60 have one part adapted to be disposed adjacent one of the overlapping strap end portions and at least another part adapted to be deformed adjacent the other of the overlapping strap end portions.

If a seal having the general configuration of the seal 60 illustrated in FIG. 4 is employed, the crown 62 need not necessarily be disposed against the strap outer end portion 52 as illustrated. Instead, the crown 62 may be disposed against the strap inner end portion 51 so that the legs 64 can be subsequently deformed against the strap outer end portion 52. However, difficulties in applying the seal 60 with the crown 62 between the strap inner end portion 52 and the bale 10 are apparent. Further, if a conventional seal structure is employed wherein the seal has legs 64, it is usually preferred to apply the seal 60 to the strap overlapping end portions in a manner such that the two legs 64 are ultimately oriented *between* the strap 20 and the bale 10 so as to reduce the likelihood of snagging the seal during handling or storage. Hence, conventional techniques for applying seals to strap typically move the seal into position from the outside of the strap loop so that the crown 62 is initially disposed adjacent the strap outer end portion 52 and so that the legs 64 can be deformed around the strap inner end portion 51. It is contemplated that the present invention is also most easily effected by initially positioning the seal 60 on the strap in the same manner.

In any case, after the seal 60 is disposed with one part adjacent one of the overlapping strap end portions 51 and 52, the seal 60 is deformed about the both of the overlapping strap end portions to close the seal and to orient another part of the seal adjacent the other of the strap end portions. The step of deforming the seal 60 includes crimping (with one or more crimps) at least one part of the seal (e.g., crown 62) against one strap end portion (e.g., portion 52) to establish a degree of frictional force engagement sufficient to either completely prevent or retard (e.g., inhibit, but not necessarily completely prevent) relative movement between the one strap end portion and the seal when the strap 20 is subjected to certain tension forces.

If some relative movement between the seal 60 and the one strap end portion is contemplated, the deformation is effected to establish a degree of frictional force engagement that is sufficient to retard the relative movement when the tension force on the strap 20 exceeds a predetermined tension force. However, the degree of frictional force engagement effected by the deformation of the seal 60 against the one strap end portion is such that the one strap end portion will not be withdrawn from the closed seal 60. The selected minimum length of the one strap end portion extending beyond the seal 60 (e.g., length X of strap end portion 52 in FIG. 6) is sufficient to accommodate the relative movement that may occur between the seal 60 and the one strap end portion. This minimum length is, of course, dependent upon (1) the degree of frictional force established between the seal and the one strap end portion and (2) the maximum tension force that may be imposed by the one strap end portion on the seal 60.

The above-discussed step of deforming the seal 60 also includes the step of crimping (with one or more crimps) *another* part of the seal 60 (e.g., seal legs 64) against the *other* strap end portion (e.g., portion 51). In the preferred method of applying the seal, the crown 62 of the seal is crimped against the strap outer end portion 52 and the legs 64 are crimped against the strap inner end portion 51.

Figure 3:
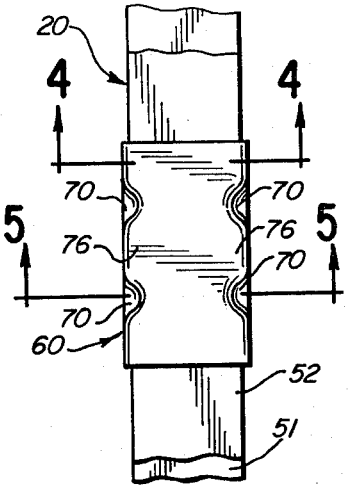
FIG. 3 is a greatly enlarged view of one of the straps on the bale of FIG. 1 showing the closed seal on the strap.
Figure 5:
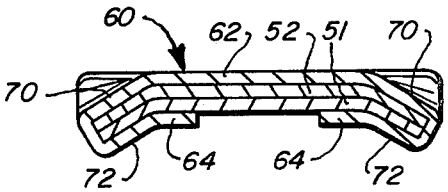
FIG. 5 is a greatly enlarged, cross-sectional view taken generally along the plane 5—5 in FIG. 3.

The crimp structure is illustrated best in FIGS. 3, 5, and 6. The margins of the seal crown 62 are deformed into an offset, an indentation, or a somewhat concave configuration 70 at two spaced locations along each side of the seal 60. This results in the seal legs 64 having an offset, a bulge, or a somewhat convex configuration 72 in registry with each indentation 70.

Between the two bulges 72, each seal leg 64 has a slight offset, indentation, or somewhat concave configuration 74. However, the seal crown 62 is not offset or bulged out on the other side of the indentation 74. Owing to the pair of spaced-apart indentations 70 on each side margin of the seal 60, the seal does define somewhat convex configurations 76 in registry with the indentations 74. However, substantially little, if any, part of the seal is deformed upwardly beyond the top of the crown 62 opposite the leg indentations 74.

It is desired to secure the strap outer end portion 52 within the seal 60 by an amount sufficient to prevent withdrawal of the strap outer end portion 52 from the closed seal 60 (even though some relative movement may be permitted). The strength of the engagement between the seal 60 and the strap outer end portion 52 is typically much greater than the strength of engagement between the seal 60 and the strap inner end portion 51.

The greater strength of the seal engagement with the strap outer end portion 52 is effected by a greater deformation of, and greater frictional contact between, the seal 60 and the strap outer end portion 52. To this end, the seal crown 62 is deformed with the four indentations 70 and the depth of each of the four indentations 70 is greater than the depth of the two indentations 74 on the other side of the seal adjacent the strap inner end portion 51.

The crown indentations 70 are so deep that the associated bulges 72 on the seal legs 64 project outwardly beyond the plane of the remaining flat portions of the seal legs 64. It is also to be noted, as best illustrated in FIG. 5, that the margins of both of the overlapping strap portions 51 and 52, as well of the seal 60, are bent into the nesting configurations 70 and 72.

By appropriate selection of seal material, by appropriate design of the crimp shapes as described above, and by formation of the crimp shapes at suitable selected deformation forces, a joint structure is provided which will permit the strap inner end portion 51 to move relative to the seal 60 (and hence relative to the strap outer end portion 52) when the tension force on the strap 20 exceeds a predetermined tension force. Specifically, the crimping of the seal 60 against the strap inner end portion 51 is effected to provide a predetermined degree of frictional force engagement which is sufficiently great to at least initially restrain the strap inner end portion 51 relative to the seal 60 until the restraint or compression of the bale 10 by the press 30 is terminated. The degree of frictional force engagement is also sufficiently great, in combination with the frictional forces between bale and strap as well as between the overlapping strap portions resulting from the subsequent bale expansion, to restrain the strap inner end portion 51 relative to the seal 60 when the imposed tension force on the strap is equal to or less than a predetermined tension force.

However, the degree of frictional force engagement is sufficiently low, in combination with the frictional forces between the bale and strap as well as between the overlapping strap portions resulting from the subsequent bale expansion, to permit relative movement between the overlapping strap end portions when the tension force on the strap exceeds the predetermined tension force.

The predetermined tension force at which the strap inner end portion 51 slips relative to the seal 60 (and relative to the strap outer end portion 52) is selected at some level below which the strap and/or seal might be in danger of catastrophically failing. Preferably, this predetermined tension force is greater than the tension forces normally imposed upon the straps 20 in a large percentage of the bales that are tied with the straps 20.

For example, in the United States of America, only about ten percent of the Universal Density bales produced may impose a load in excess of about 2500 pounds on each strap (where the bale is tied with six 0.75 inch wide straps spaced along the bale as illustrated in FIG. 1.) Thus, the novel seal and strap configuration disclosed herein can be designed to permit the strap inner end portion 51 to slip when the imposed tension force exceeds 2500 pounds per strap. In those ten percent of the bales where the 2500 pound force is exceeded, the strap inner end portion 51 will slip some amount. The seal may be designed to permit strap slippage at other tension loads—the seal design being modified as necessary to accommodate the particular bale size, bale density, bale material, strap and seal materials, strap size, and seal size.

Initially, the strap inner end portion 51 is disposed at least partially around the bale corner with a predetermined length extending to the position indicated in dashed lines in FIG. 6. Opening of the press 30 permits the bale 10 to expand tightly against the strap 20 if the strap had been initially disposed somewhat loosely about the bale. In any case, opening of the press 30 permits the full expansion force of the bale to be imposed upon the straps 20. If the force imposed on any of the straps 20 exceeds the predetermined design tension force, at least the strap inner end portion 51 will slip relative to the seal 60 (to the position illustrated in solid lines in FIG. 6). As described above, an alternative form of the invention may also accommodate some slippage of the outer strap end portion 52 relative to the seal 60.

In any case slippage of one or both of the strap end portions 51 and 52 will cause the strap loop 20 to become larger and thus allow the bale to expand slightly. As the bale 10 expands, the pressure will be reduced and the tension force imposed upon the strap 20 will cause no further movement of the strap end portion or portions when the imposed tension force on the strap is less than the combined frictional engagement forces acting on the strap.

The combined frictional engagement forces acting on the strap 20 arise from a number of sources. First, the strap inner end portion 51, which may extend partially or fully around the corner of the bale 10, is subjected to an outward expansion force, schematically illustrated by force vectors 80, when the press 30 is opened. The expansion force of the bale 10 causes a frictional engagement between the strap inner end portion 51 and the strap outer end portion 52 at the top surface of the bale 10.

Second, there is a significant amount of frictional engagement between the overlapping strap end portions at the vertical side of the bale 10. The vertical sides of the bale 10 typically expand outwardly less than the horizontal sides of the bale 10 expand outwardly after the opening of a conventional high density cotton bale press. Thus, the amount of frictional engagement of a given length of the strap inner end portion 51 with the strap outer end portion 52 along the vertical side surface between the seal 60 and the bale corner will be less when compared to the engagement of an equal length of overlapping strap portions at the other (top horizontal) side surface of the bale adjacent that corner.

Third, there is some frictional engagement between the confronting surfaces of the overlapping strap end portions 51 and 52 *within* the seal 60 per se.

Fourth, there is the frictional engagement between the seal legs 64 and the strap inner end portion 51. (Where slippage is contemplated between the seal 60 and the strap outer end portion 52, there is also a frictional engagement force between the seal crown 62 and the strap end portion 52 that will retard such slippage as described hereinbefore).

Fifth, there is some the frictional engagement between the bale outer surfaces and the strap inner surface 42 around the entire periphery of the bale.

For a given size bale of known material at an initial compression density, one can select (1) a predetermined length of the inner end portion 51 of the strap having known frictional chracteristics and (2) the specific crimp engagement structure so as to permit the desired slippage when the tension force imposed upon the strap 20 exceeds a predetermined amount.

In FIG. 6, the strap inner end portion 51 is shown extending around and past the corner of the bale 10. However, for a given bale, it may be desirable in some applications for the strap inner end portion 51 to extend only partially around the bale corner so as to avoid further excessive frictional forces that would prevent slippage at the predetermined maximum tension force.

The relative slippage of the strap inner and outer end portions, described above, need not be particularly great. The strap and seal system can be designed so that the slippage of the strap, when subjected to the overload condition, will be about one inch or less. With a Universal Density cotton bale, a one inch slippage of the strap will result in an increase in the width and height of the bale of one half inch or less. Such a small amount of bale growth will not appreciably affect the final density of the bale after the press is opened. Even though the bale density does not significantly change when the strap 20 slips, the strap slippage is sufficient to reduce the strap loading (e.g., a 20 percent reduction in strap tension force) so as to prevent catastrophic failure of the strap and/or seal.

The capability of the novel structure described herein to accommodate initial expansion of a high density bale released from a press in a manner that reduces, or eliminates all together, the likelihood of catastrophic failure of the seal and strap is also useful in accommodating other loading conditions that may be imposed upon the strap. Specifically, during handling and transportation, the bale and strap may be subjected to transient impact loads or to other environmental loads. Such loads may affect only a portion of the bale and only some of the straps on the bale. However, since the straps can slip if the load exceeds the design load, such loads will be less likely to cause a catastrophic failure of the strap.

Further, since the seal is only crimped, and not notched, severed, or otherwise cut, the seal is less likely to be snagged during handling than is a conventional notched seal.

Also, since the strap is not notched, severed, or otherwise cut under the seal, the cross section of the strap is not reduced. Transmission of tension forces throughout the strap can thus occur across the entire strap cross section. Further, the lack of notches or other penetrations into the strap cross section contributes to reducing the number of discontinuities in the strap which could serve as incipient failure points.

It has been found that the seal notcher mechanism of a conventional power strapping machine can be modified to provide the crimped seal structure described above. Signode Corporation, the assignee of the present invention and located at 3600 West Lake Ave., Glenview, Ill. 60025 U.S.A., manufactures and sells a Model M361 power strapping machine which incorporates a seal notcher mechanism. The seal notcher mechanism, and a notched seal formed by such a mechanism, are illustrated and described in the "Operation And Safety Manual" for the Model M361 power strapping machine (catalog publication designation "E-186177 8/81-1500"). The seal illustrated on pages 11 and 12 of that publication is shown with three, spaced-apart notches along each side margin of the seal to provide an interlocking engagement of the seal with both of the overlapping strap portions. The three notches are formed by notcher plates along each side of the seal between four spaced-apart jaws arranged so that each notch is formed between two of the four jaws engaged with the seal.

The seal structure of the present invention may be formed by modifying the above-described seal notcher assembly. Specifically, three, rather than four, spaced-apart jaws are disposed along each side of the seal. Two, rather than three, notcher plates are provided between the jaws. However, the shape of the notcher plates is modified and the depth of the notcher plate engagement with the seal is reduced so that the seal is no longer notched per se. Rather, the seal is merely deformed and crimped into engagement (without breaking the surfaces of the seal or of the overlapping strap portions) as explained above in detail with reference to FIGS. 3–6.

From the foregoing, it will be observed that numerous and various modifications may be effected without the departing from the true spirit and scope of the novel concept of the invention. It is to be understood that no limitation with respect to the specific structure and method illustrated herein is intended or should be inferred. It is, of course, intended to cover by the appended claims all such modifications as fall within the scope of the claims.

What is claimed is:

1. In combination, the elements comprising:

a bale of compressed resilient material having a generally parallelpiped shape with four side surfaces and two end surfaces;

at least one strap with two oppositely facing major side surfaces having predetermined frictional characteristics disposed in a loop around the bale to overlap a predetermined length of an inner end portion of the strap adjacent the bale with an outer end portion of the strap so that the confronting strap surfaces of the overlapping end portions are generally in surface contact or in alignment to be in surface contact for effecting a frictional engagement, said strap inner end portion being disposed at least partially around one corner defined by two of said bale side surfaces; and a seal at one of said bale side surfaces defining said one corner of said bale, said seal being deformed closed about both of said overlapping strap end portions with one part of said seal adjacent one of said overlapping strap end portions and with another part of said seal adjacent the other of said overlapping strap end portions, said deformed closed seal including:

(1) a crimp of said one part of said seal against said one of strap end portion to prevent withdrawal of said one strap end portion from said closed seal, and (2) a crimp of said other part of said seal against said other strap end portion with a predetermined degree of frictional force engagement which, in combination with the frictional forces between the bale and the strap as well as between the overlapping strap portions resulting from the bale expansion, is sufficiently great to restrain said other strap end portion relative to said seal when the tension force on said strap is equal to or less than a predetermined tension force but which is sufficiently low to permit relative movement between said overlapping strap end portions when the tension force on said strap exceeds said predetermined tension force.

2. The combination in accordance with claim 1 in which said crimp of said other part of said seal against said other strap end portion is defined by a deformation of both said seal and said other strap end into a generally offset configuration.

* * * * *